US005467892A

United States Patent [19]

Schlamp

[11] Patent Number: 5,467,892

[45] Date of Patent: Nov. 21, 1995

[54] VENDING DEVICE

[75] Inventor: Hans Schlamp, Munich, Germany

[73] Assignee: Accumulata Verwaltungsgesellschaft GmbH, Munich, Germany

[21] Appl. No.: 304,033

[22] Filed: Sep. 9, 1994

Related U.S. Application Data

[62] Division of Ser. No. 10,934, Jan. 29, 1993, Pat. No. 5,385, 265.

[30] Foreign Application Priority Data

Jan. 31, 1992 [DE] Germany ..... 42 02 801.9

[51] Int. Cl.[6] ..... G07F 11/00

[52] U.S. Cl. ..... 221/7; 221/129

[58] Field of Search ..... 221/2, 7, 76, 77, 221/191, 129, 131, 120, 121; 364/479, 478

[56] References Cited

U.S. PATENT DOCUMENTS

| | | | |
|---|---|---|---|
| 2,313,424 | 3/1943 | Esgro | 221/7 |
| 3,128,013 | 4/1964 | Holstein et al. | 221/129 |
| 3,164,294 | 1/1965 | Phillips et al. | 221/84 |
| 4,560,088 | 12/1985 | Tan | 221/75 |
| 4,812,629 | 3/1989 | O'Neil et al. | 235/383 |
| 4,961,507 | 10/1990 | Higgins | 221/129 |
| 5,088,586 | 2/1992 | Isobe et al. | 194/205 |
| 5,169,027 | 12/1992 | Falk et al. | 221/2 |

FOREIGN PATENT DOCUMENTS

| | | |
|---|---|---|
| 3314189 | 10/1983 | Denmark . |
| 3530188 | 4/1989 | Denmark . |
| 3914686 | 3/1991 | Denmark . |
| 0234833 | 9/1987 | European Pat. Off. . |
| 2306021 | 10/1976 | France . |
| 2343521 | 10/1977 | France . |
| 2563985 | 11/1985 | France . |
| 2643479 | 8/1990 | France . |
| 3914686A1 | 3/1991 | Germany . |
| WO88/02524 | 4/1988 | WIPO . |

*Primary Examiner*—Kenneth Noland

*Attorney, Agent, or Firm*—Spencer, Frank & Schneider

[57] ABSTRACT

The invention pertains to a vending device with a number of compartments (11,23,23A,32) that serve as receptacles for goods, whereby a computing unit (50) with a memory, at least one display unit (7,12) and at least one input device (8,9) is provided, whereby at least one compartment (11,23, 23A,32) is assigned to a merchant by the computing unit (50) to load at least one compartment (11,23,23A,32) after the merchant has entered his identifying merchant code into the input device (8,9), and whereby the computing unit (50) makes the withdrawal of goods from the compartment (11,23,23A,32) loaded with goods possible by releasing a compartment (11,23,23A,32) after the customer has entered an identification code into the input device (8,9). The compartments (11,23,23A,32) are part of a storage unit (2,20,20A,30) provided with a transport device (10,25,25A, 35) which, controlled by the computing unit (50), can transfer each compartment (11) into the area of an opening (4,40) that can be locked, or remove a container (22,22A) from any compartment and transport the same into the area of an opening (4,40) that can be locked. The opening (4,40) can be released by the computing unit (50) to load at least one compartment (11,23,23A,32) with goods after the identification code of the merchant has been entered and to withdraw goods from the compartments (11,23,23A,32) after the identification code of the customer has been entered.

8 Claims, 5 Drawing Sheets

Figure 2A:
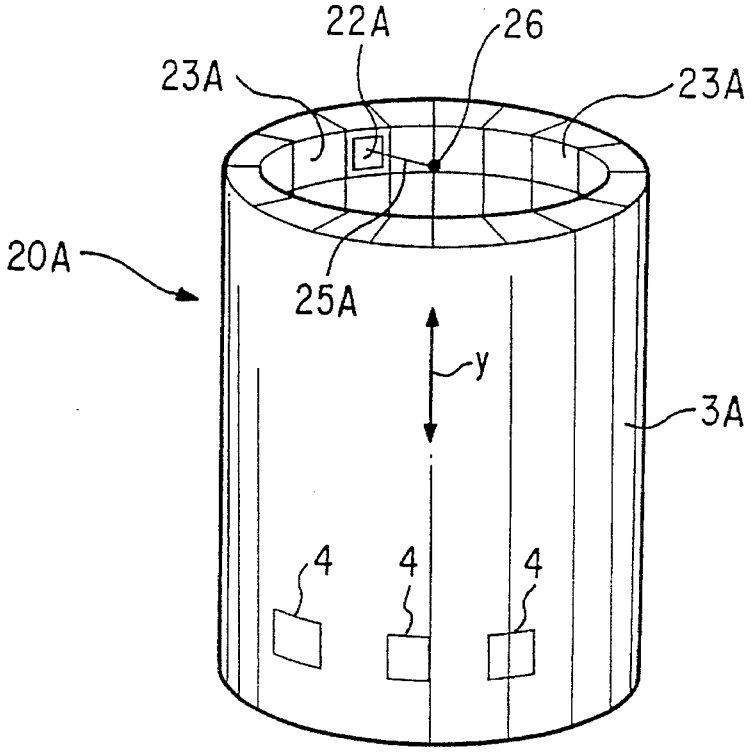

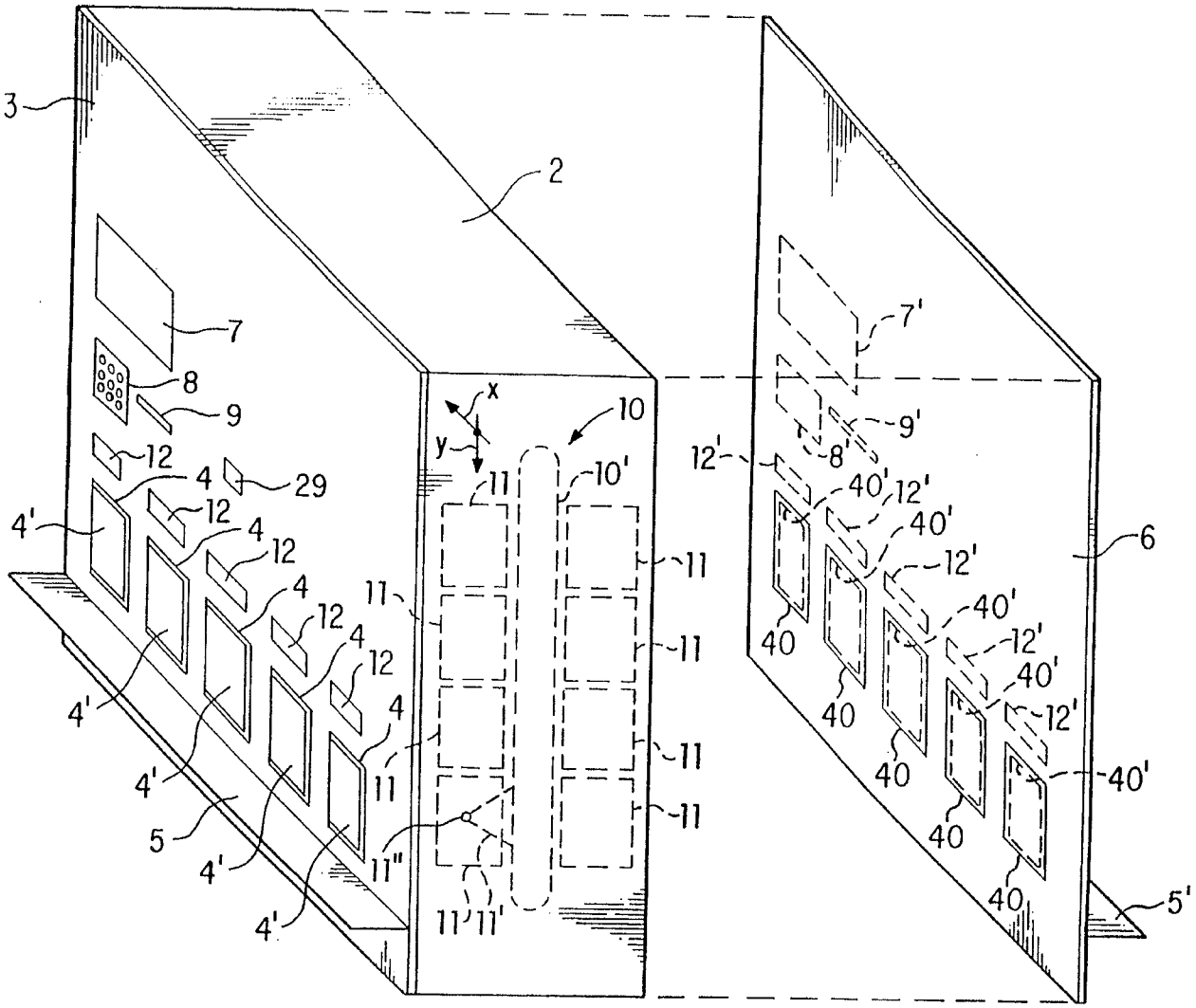
3
2
7
8
9
29
4'
12
4
12
4
12
4

VENDING DEVICE

This is a divisional of application Ser. No. 08/010,934 filed Jan. 29, 1993 now U.S. Pat. No. 5,385,265.

FIELD OF THE INVENTION

The invention pertains to a vending device according to the precharacterizing portion of Claim 1.

BACKGROUND OF THE INVENTION

DE-OS 39 14 686.3 disclosed a vending system of this type in which a number of compartments that can be locked with doors is arranged within a vending room. A merchant code of at least one merchant and a predetermined number of account numbers and possibly even customer numbers of the customers are stored in a memory. The merchant enters an identifying merchant code in order to reserve a compartment, whereafter the computing unit of the system reserves a compartment once the account number assigned to the given customer has been entered. The merchant enters the price of the goods to be placed into the assigned compartment into the memory via the computing unit. The computing unit displays a suitable compartment to receive the goods on the display device and causes the door of the displayed compartment to unlock. After the goods have been placed into the displayed compartment, the computing unit causes the door to lock again.

The customer gains access to withdraw the designated goods by entering an account number identifying the customer and possibly also his own customer number. The computing unit displays the compartment reserved for the customer on the display device and unlocks the door of the compartment reserved for the customer. The computing unit causes the door of the displayed compartment to lock after the goods have been withdrawn.

One problem of such a vending system can be seen in the fact that the arrangement of the compartments requires a relatively large space. In other words, a separate room that is lost as sales area is usually required to accommodate this known vending system. The surface area occupied by the compartments is very large because direct access to each area within human reach is required with this known system, whereby this direct access extends from approximately 50 cm up to no more than 2 m from the floor. The manufacture of this known vending system is relatively expensive because a separate door and unlocking device with the corresponding control electronics to access it is required for each compartment. Due to the arrangement of the large number of doors, the entire system is susceptible to defects in regard to the mechanical system, as well as the electronics controlling the locking and unlocking of the doors.

DESCRIPTION OF THE INVENTION

The invention is based on the objective to introduce a vending device that can be manufactured more economically as compared to the state of the art and occupies comparatively less of the valuable sales space.

According to the invention, this objective is attained by a vending device of the initially mentioned type which is characterized by the measures disclosed in the characterizing portion of Claim 1.

The substantial advantage of the invention can be seen in the fact that the vending device according to the invention requires much less space or valuable sales space than the known vending system. The vending device according to the invention can operate relatively cost effectively because sales space is very expensive. It should also be noted that the vending device according to the invention does not require a separate vending room as it is required with the known vending system. The vending device can be installed in such a way that the withdrawal opening(s) and the necessary operation and display units (monitor, reading device, keyboard) are arranged in a wall accessible to the customer and the merchant, while the storage unit itself is essentially arranged in a basement or a room located behind the wall. The area within human reach is substantially smaller than the one previously mentioned in connection with the state of the art because access to only a few withdrawal/loading openings is required. It is also possible to install this vending device in such a way that one or more loading openings are arranged so as to be comfortably within access to the merchant and separated from the withdrawal openings. It is, for example, conceivable that the withdrawal openings and the aforementioned operation and display units are arranged in a wall of the store in such a way that they are externally accessible to the customer, while the loading openings can be directly accessed by the merchant from the store. This means that the distance required for the merchant to access the system is substantially reduced. This vending system is comparatively less susceptible to defects and can also be manufactured relatively economically because only a few withdrawal openings and thus also only a few doors with corresponding locking and unlocking devices as well as the corresponding access electronics are required. A further substantial advantage can be seen in the fact that such a vending device can be cooled in a comparatively simple manner because the entire storage unit can be arranged within only one single cooling room or shaft. This cooling shaft can be refrigerating with prefabricated refrigeration units available on the market, whereby only one single refrigerating machine is required. In the simplest solution of the objective according to the invention, the cooling room can be constructed by remodeling a storage area with insulating layers. Standard units that are already on the market and have proven themselves in practical applications can be advantageously utilized as the storage unit.

Advantageous further developments of the invention are disclosed in the subclaims.

BRIEF DESCRIPTION OF THE INVENTION

Figure 1A:
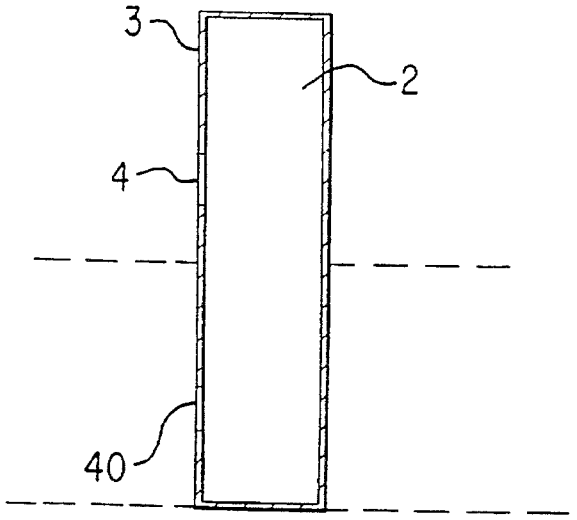
Figure 2:
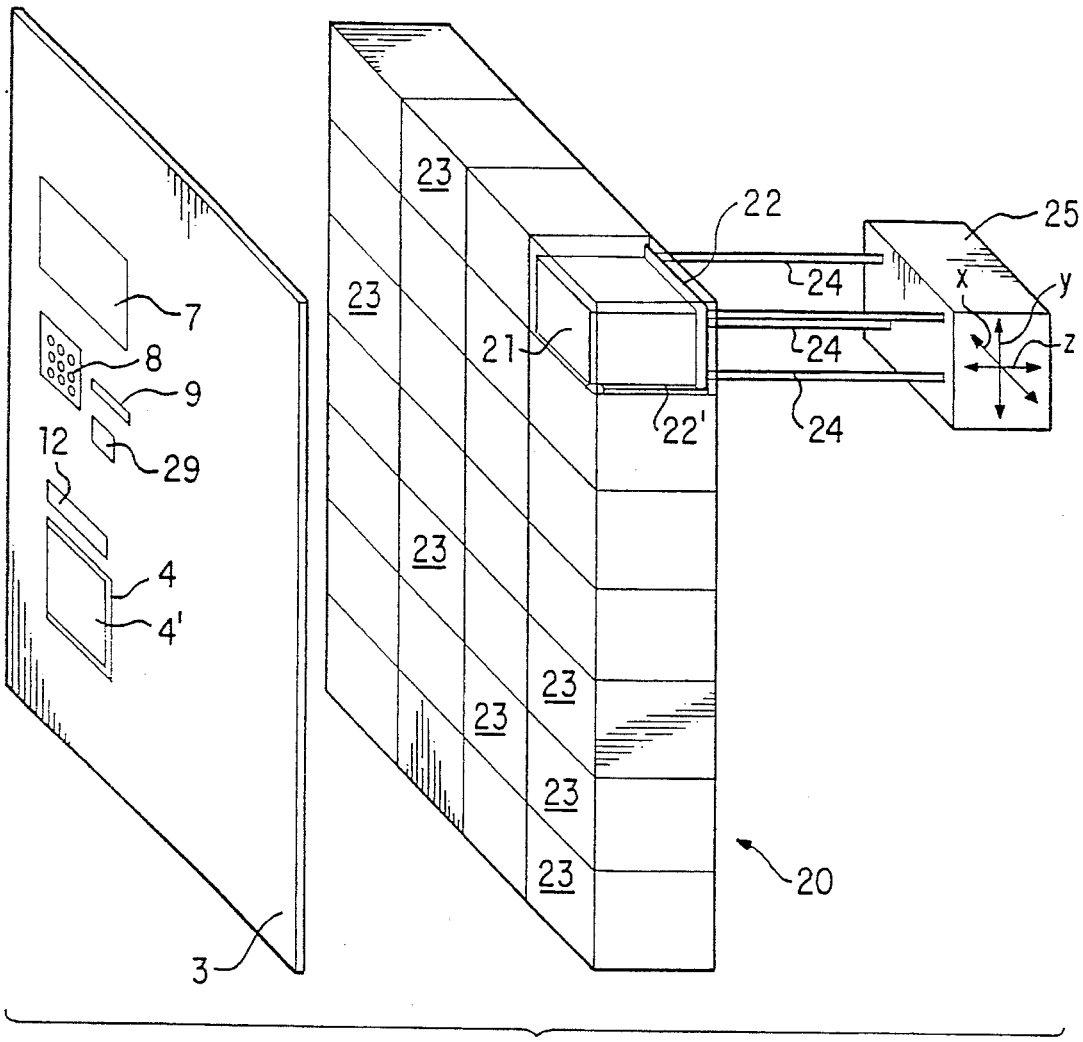
Figure 3:
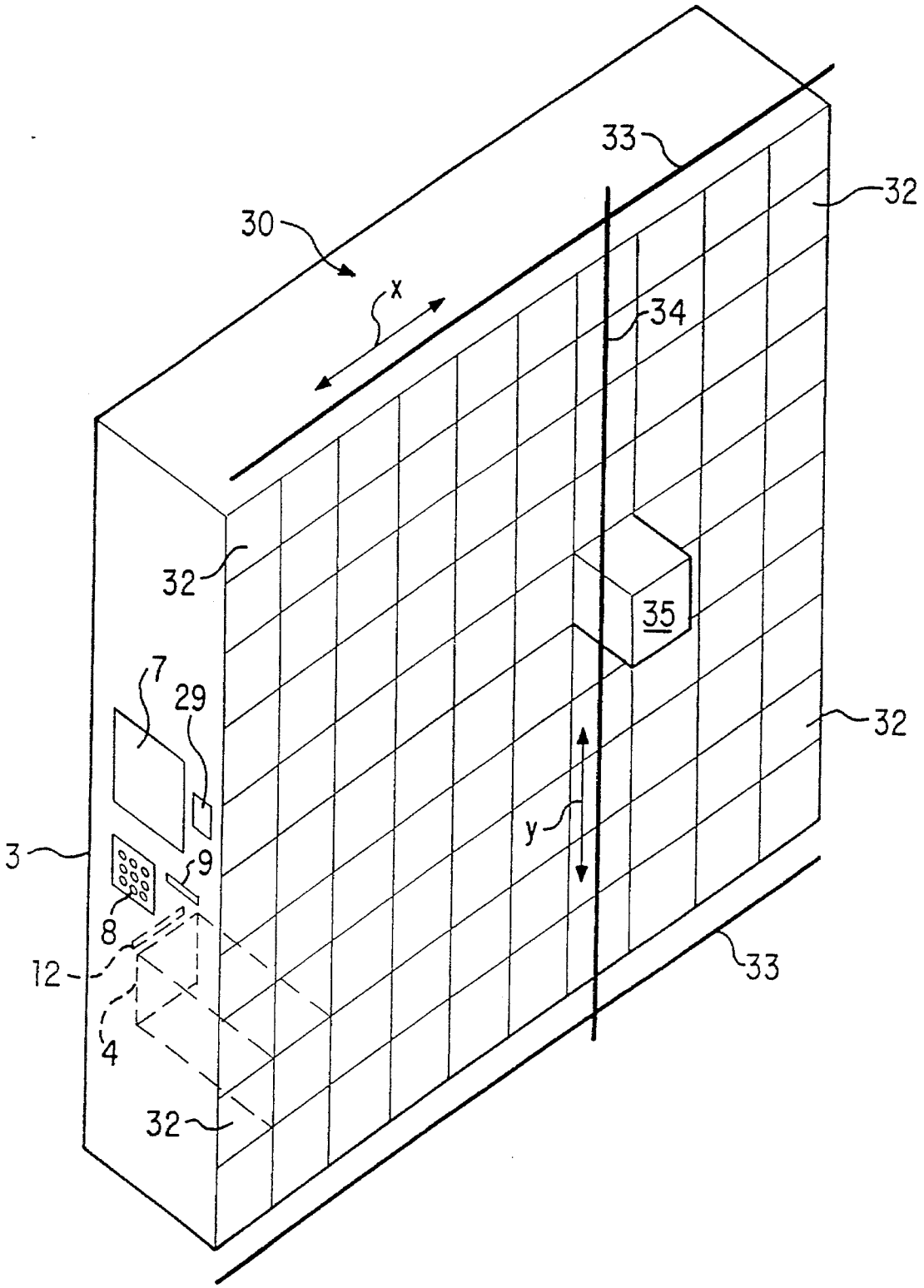
Figure 4:
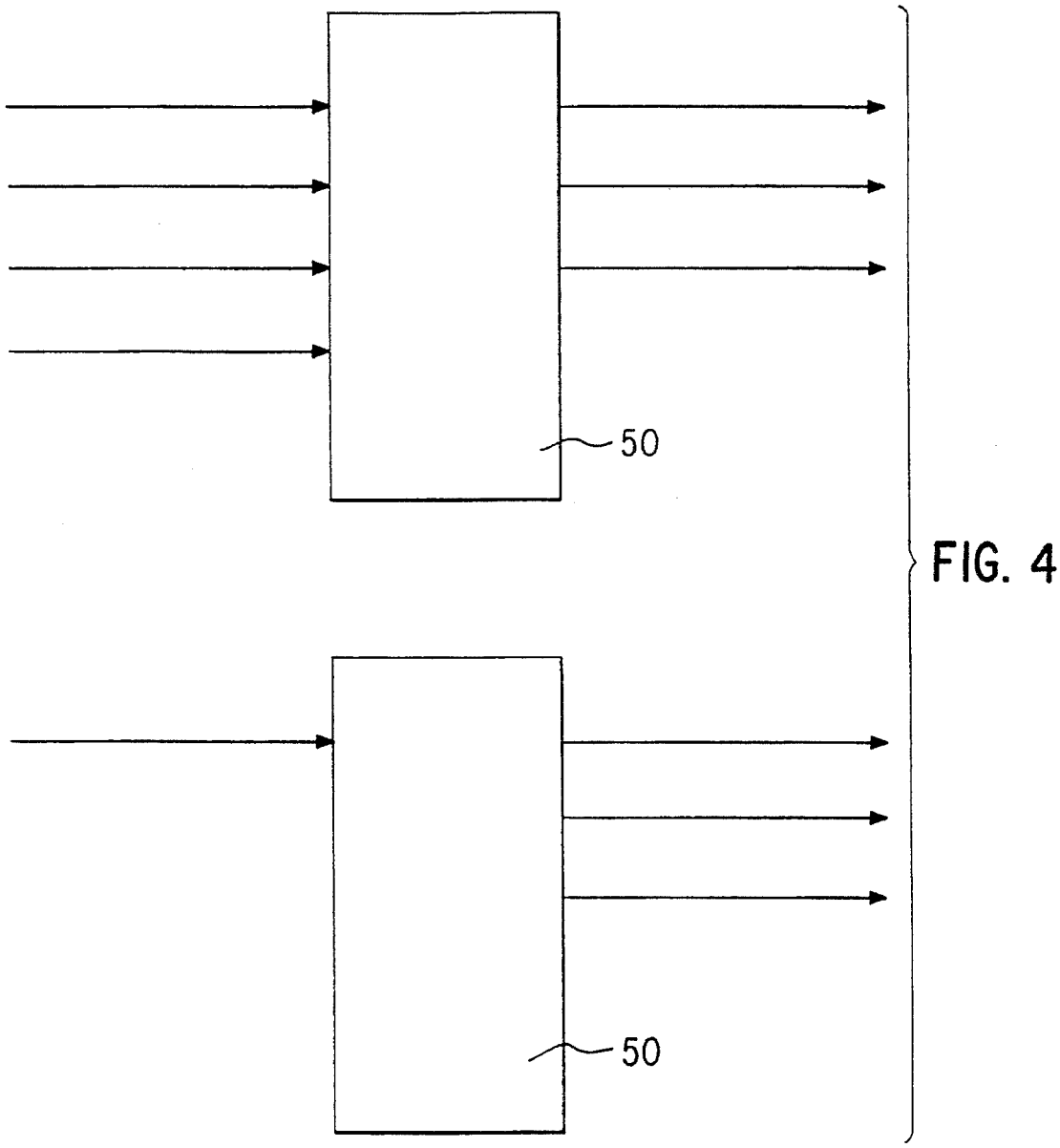

The invention and variations of the same are in the following described in detail with the aid of the figures. They show:

FIG. 1, 1A a vending device according to the invention in schematic representation;

FIG. 2, 2A and 3 further variations of the vending device according to the invention, and FIG. 4 a block diagram to explain the access to the vending device according to the invention via a computing unit.

A storage unit is marked with the reference numeral (2) in FIG. 1. Generally speaking, compartments or containers that serve as receptacles for goods are arranged within the smallest possible space in this storage unit (2) that can be constructed in the most varied ways, as described later in the text, in such a way that they can be transported or conveyed to at least one withdrawal opening (4). Several of such withdrawal openings (4) can, for example, be arranged in a metal wall (3) closing one side of the storage unit (2) in such a way that the compartments or containers of the storage unit (2) can be arranged behind the withdrawal openings to load or withdraw goods onto/from the compartments.

FIG. 1 schematically illustrates by broken lines that the storage unit (2) can, for example, be a device in which a transport apparatus (10) operating according to the elevator principle has several compartments (11) arranged in the Y-direction atop one other which extend as rows in X-direction on the side facing the metal wall (3) as well as on the side opposing the metal wall (3) in such a way that the compartments (11) of the individual rows can be moved behind the withdrawal openings (4) which can simultaneously serve as the loading openings. In the example shown in the figures this means that five compartments (11) are provided in the X-direction in accordance with the numbering of the openings (4). The compartments (11) are, for example, mounted in conventional manner to a schematically illustrated conveyor device (10'), for example, an endless conveyor belt or an endless chain conveyor, in such a way that they maintain a position in which their compartment openings are aligned horizontally during the rotation of the conveyor and that they point toward the metal wall (3) or a rear wall or another metal wall (6). The compartments (11) are, for example, retained on the conveyor (10) by arms (11') in such a way that they can be rotated around an axis (11") as schematically indicated for the lower left compartment (11).

In order to load a compartment (11) with goods, one of the withdrawal/loading openings (4) behind which an empty compartment (11) is located is displayed to the merchant in a manner described later in detail. After the door (4') of the opening (4) has been unlocked, the goods ordered by the customer can be placed into this compartment (11) by the merchant. The loaded compartment (11) is moved as desired within the storage unit (2) during subsequent withdrawal or loading operations after the door (4') has been locked. The door (4') is equipped with a locking device (not illustrated in the figure).

In order to collect the goods, a withdrawal/loading opening (4) is displayed to the customer in a manner described later in detail, whereby the compartment (11) containing the goods previously ordered by the customer is conveyed behind the withdrawal/loading opening by activating the conveyor device (10'). The customer can collect the desired goods after the respective door (4') is unlocked.

It should be noted that the doors (4') schematically illustrated in FIG. 1 can be all possible doors, flaps or other devices that can be opened after activating an unlocking device, for example, those swiveled about a hinge (not shown in the figure) or displaced in the plane of the metal wall (3) after activating the unlocking device in order to release the withdrawal/loading opening (4).

FIG. 1 shows that the withdrawal and the loading of the compartments (11) can be executed through the openings (4) in the metal wall (3). However, it is also conceivable to provide separate withdrawal and loading openings. The withdrawal can, for example, be executed as thus far described through the openings (4), while the loading is executed through openings (40) that can be located in the aforementioned metal wall (6) on the rear side of the storage unit (2). In this particular variation of the invention, the vending device can be arranged in such a way that the loading is executed through the metal wall (6) from the store itself, while the withdrawal of the goods is executed outside the store through the metal wall (3). A shelf (5 or 5') can be arranged below the openings (4 or 40).

Depending on the requirements it is also conceivable to execute the withdrawal and loading according to FIG. 1A through one and the same metal wall (3) at separate locations. In this particular instance the openings (4) as well as the openings (40) are arranged separately from each other in the metal wall (3). The openings (40) provided below the openings (4) are, for example, accessible from a basement room in order to be loaded by the merchant, while the openings (4) are accessible to the customer to withdraw the goods from a sales floor arranged above the basement.

Instead of the storage unit (2) provided with compartments (11) and described in connection with. FIG. 1, it is also possible to provide any conceivable device that is able to move or transport one compartment of a number of compartments or one container of a number of containers behind at least one withdrawal/loading opening (4) by mechanical movements or transport processes.

The variation described in FIG. 2 shows that it is also possible to provided a shelf-like structure (20) behind the metal wall (3) as the storage unit, whereby containers (21) suitable to serve as receptacles for the goods ordered by the customer are arranged in the compartments (23) of the shelf-like structure. These containers (21) are grasped by the schematically illustrated gripping apparatus (22) of a transport device (25), removed from the shelf-like structure (20) (Z-direction) and moved to at least one withdrawal/loading opening (4) in the metal wall (3) in such a way (X- and Y-direction) that the container (21) arranged behind the withdrawal/loading opening (4) is accessible for withdrawal of the goods through the withdrawal/loading opening (4) after the door (4') is opened. The individual compartments (23) of the shelf-like structure (20) are preferably arranged in the form of rows (X-direction) and columns (Y-direction), so that each compartment (23) is accessible for the gripping device (22) by the coordinated movement of the transport device (25).

This gripping device (22) is, for example, provided with a plate (22') that can be pushed under the container and is connected with the transport device (25) via retention rods (24) or similar elements. A loaded container (21) can thus be removed from a compartment (23) by moving the transport device (25) in the Z-direction, and an empty container (21) can be placed into a compartment (23). It should also be noted that any arbitrary gripping devices (22) could be utilized by means of which the withdrawal of the container (21) from a compartment (23), its transport behind the area of the withdrawal/loading opening (4) and the return of the container (21) into a compartment (23) is possible.

According to FIG. 2A, it is also conceivable to construct the device (20A) with the compartments (23A) for the containers in the form of a hollow cylinder, so that the compartments (23A) can be accessed by a gripping device (22A) that can be rotated around a central fulcrum (26) and raised and lowered in the Y-direction. At least one withdrawal/loading opening (4) is arranged in an outer metal wall (3A) that covers the hollow cylinder. If several openings (4) are provided, these openings are preferably arranged next to each other in the peripheral direction so that they can be accessed at one elevation during rotation of the gripping device. Such vending devices can have the shape of large vending silos.

FIG. 3 shows that other devices in which the goods are stored in the compartments (32) of storage unit (30) are also conceivable. The goods are, for example, conveyed to a withdrawal opening (4) in a coordinated manner in order to withdraw them. The goods are, for example, placed manually into the compartments (32) of a cabinet-like storage unit (30), whereby certain goods are always arranged in certain compartments (32), the addresses or coordinates of which are known. The withdrawal device (31) can, for example, be displaced to each compartment for the withdrawal of goods in the X- and Y-directions by a mechanical transport device (33,34) (not described in detail). The withdrawal device (31) can receive certain goods from a predetermined compartment (32) by transfer to a container (35) assigned to it, and convey the container to a withdrawal opening (4) on the side of the storage unit (30) opposite to the container (35) arranged in a metal wall (3) at the location of the predetermined compartment (32), or reversely.

FIGS. 1 and 3 show that operating elements, in particular an input device and display units are provided on the metal wall (3) by means of which the vending device according to the invention can be loaded with goods by a merchant, and by means of which a customer can empty the compartments (11) or containers (21) loaded for him by the merchant. The display unit can be, in particular, a monitor (7), as well as, possibly, lamps (12). The input device can, for example, be a slot (9) of a reading device and/or a keyboard (8).

Such operation and display units as well as input devices are provided in the area of the withdrawal opening (4) as well as in the area of loading openings (40) if the withdrawal and loading openings (4,40) are arranged separately from each other. The elements provided on the metal wall (6) in FIG. 1 are marked with the reference numerals (7',8',9')

A sale is in the following described in connection with FIG. 4. A customer who would like to obtain certain goods during times at which the store is closed places his order with a merchant that has access to the vending device according to the invention, preferably by telephone during normal business hours. It is practical if merchants of several different stores have access to the vending device so that a great variety of goods can be sold in the compartments (11) (FIG. 1). After the merchant has received the order, he collects the ordered goods and transports them to the loading opening (4 or 40) of the vending device according to the invention. He subsequently enters an identifying merchant code via the keyboard (8 or 8') or the slot (9 or 9') of the reading device. The merchant additionally enters the price of the ordered goods as well as an identifying customer number via the keyboard (8 or 8'). Based on the information contained in the memory of a computing unit (50) assigned to the described operating elements, the computing unit (50) checks the entered merchant code to determine if the merchant is authorized to load the compartment. The price entered via the keyboard (8 or 8') is assigned to a certain customer by the computing unit (50) based on the customer number entered by the merchant via the keyboard (8 or 8'). In the example according to FIG. 1, the computing unit (50) subsequently determines a free compartment (11) and moves it behind one of the loading openings (4) by transmitting a control signal to the device (10). Since the computing unit itself determines the free compartment (11), the respective compartment number or compartment address is always available to the computing unit. The selected opening (4) is displayed to the merchant on the monitor (7 or 7') or by illuminated display lamps (12 or 12') arranged above the corresponding compartment, or by any other arbitrary display unit. The computing unit (50) releases a display signal for this purpose. The unlocking device of the corresponding door (4' or 40') is simultaneously released by producing an unlocking signal in order to load the compartment. The merchant can now load the displayed compartment (11) by opening the door (4' or 40'). The door is automatically locked after the loading of the compartment is concluded. This is preferably achieved by the fact that the locking device (not shown in the figures) automatically locks the door once more after a predetermined elapsed time, reckoned from the unlocking of the door.

Identical processes are executed in the example according to FIG. 2, whereby an empty container (21) is removed from a compartment (23) by the transport device (25) and conveyed to the withdrawal/loading opening (4). If only one opening (4) is present, the display device (12) or the monitor (7) only displays to the merchant that the locking device of the door (4') is unlocked. The procedures described in connection with FIG. 1 are executed if several connections or loading openings (4) are present.

In the example according to FIG. 3, the merchant additionally enters the address or compartment number of the compartment (32) be reserved. All other processes are executed in the same manner as in FIG. 1.

During the withdrawal of the goods, the customer enters an identifying code that can, for example, be the account number and possibly a customer number into the computing unit via the keyboard (8) and/or the slot (9) of the reading device. The computing unit (50) then checks if the customer is authorized to withdraw the goods based on the identification code stored in its memory. In the example according to FIG. 1, the device (10) subsequently conveys the compartment(s) (11) reserved for the customer behind one or more withdrawal openings (4) based on the control signals released by the computing unit (3). The corresponding withdrawal openings (4) are displayed to the customer on the monitor (7) or via illumination of the corresponding display lamps (12) or via the means of the other aforementioned elements. The corresponding doors (4') are simultaneously unlocked, so that the customer can withdrawal the goods placed into the compartments (11) by opening the door (4'). If the goods are issued through several doors (4'), the corresponding withdrawal openings (4) are preferably displayed successively by illumination of the display lamps (12) because a door (4') is automatically locked once more after a predetermined elapsed time, reckoned from the unlocking of the door. This means that at first only a first door (4') is displayed, and another door is subsequently unlocked and displayed after the first door was automatically locked and a locking signal was produced.

In the examples according to FIGS. 1, 2, 2A and 3, a compartment (11) or a container (21) or several compartments or containers that contain the goods for the customer are successively conveyed to the withdrawal opening (4) by the transport device (25), so that the customer can withdraw the goods in the previously described manner. The sale is executed in the previously described manner if several openings (4) are provided.

If a merchant reserves several compartments (11,32) or containers (21,21A) for a customer, the duration between the withdrawal of goods from a compartment can be determined by the customer himself if a receipt key (29) is provided in the area of the withdrawal opening (4). After the customer withdraws the goods from a compartment, he activates the receipt key (29) to produce a receipt signal. Once a receipt signal and the locking signal produced when the compartment is closed are present, the computing unit (50) causes the transport device (10,25,25A,35) to move and the goods to be conveyed to the same opening or a different opening (4) which is displayed to the customer.

It is preferably ensured that the doors (4' or 40') automatically return into their closing position after they are released by the customer or the merchant, so that the least possible amount of cold air can escape from the storage unit.

If separate withdrawal openings (4) and loading openings (40) are provided, then the computing unit (50) contains a so-called conversion table that makes the address coordination possible based on the offset between of the withdrawal openings (4) and the loading openings (40').

The reservation of a compartment according to the German Patent Application P 41 30 033.5 is also possible with the vending device according to the invention.

It should be noted that a quasi-parallel operation is possible in the variations according to FIGS. 2, 2A and 3 if several openings (4) are provided. This means that the transport device (25,25A,35) can operate in a temporally overlapping manner and that the transport device can convey a different container which contains goods for the same customer behind another still locked opening (4) while the goods are withdrawn from one container.

It should furthermore be noted that the storage units are devices with a shelf-like structure and of large capacity (FIGS. 2, 2A, 3) or large silos (FIG. 2A). The loading of these storage units with goods or the withdrawal of goods from these storage units is executed through one or relatively few withdrawal/loading openings that require little sales space in a wall or similar structure and can be easily operated by the customer or merchant. This invention represents the first instance in which the idea of a number of compartments with doors according to the known vending system has been abolished, and the assignment of only one or few withdrawal/loading openings to a large number of compartments and their access in a specialized manner via the computing unit is implemented in its place.

We would furthermore like to mention that it would also be conceivable to construct the vending device according to the invention in the described manner to withdraw the goods, and to perform the loading of the goods in a different manner. It is, for example, possible to introduce the goods directly into the compartments instead of through the openings (4 or 40).

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

I claim:

1. Vending system with a number of compartments that serve as receptacles for goods, comprising a computing unit with a memory, at least one display unit and at least one input device is provided, whereby at least one compartment is assigned to a merchant by the computing unit to load at least one compartment after the merchant has entered his identifying merchant code into the input device, and whereby the computing unit makes the withdrawal of goods from the compartment loaded with goods possible by releasing a compartment after the customer has entered an identification code into the input device, the compartments are part of a storage unit that is provided with a transport device which can, under control of the computing unit, transport any compartment into the area of an opening that can be locked, or remove a contaienr from any compartment and transport it into the area of an opening that can be locked, and the opening can be released by the computing unit in order to load at least one compartment with goods after the identification code of the merchant has been entered, and in order to withdraw goods from a compartment after the identification code of the customer has been entered;

the storage unit is provided with an endless conveyor belt as the transport device in which several rows of compartments arranged next to each other are arranged atop one another in such a way that the compartments of one row are aligned with the compartments of the row arranged on top of it, and the compartments can be transported in a elevator-like manner behind openings arranged next to each other in a wall of the storage unit in accordance with the distance between the compartments of one row;

openings are provided to load the compartment with goods and to withdraw goods from the compartments; and a display unit which can be controlled by the computing unit is assigned to each opening, and the display unit serves the purpose of displaying the compartment reserved for the customer during the withdrawal from it or to display an empty compartment reserved for the merchant during the loading process.

2. System according to claim 1, wherein the movable gripping apparatus grasps containers located in the compartments to receive the goods, and the gripping apparatus can transport the container to at least one opening of the storage unit, and reversely.

3. System according to claim 2, characterized by the fact that the storage unit (20) has several rows of compartments (23) arranged next to each other that are placed atop of one another in such a way that the compartments (23) of the rows arranged atop one another are aligned with each other in the form of columns, and that the transport device (25) can be moved in the direction of the rows and columns to access the compartments.

4. System according to claim 3, characterized by the fact that the transport device (25) can be moved in a direction perpendicular to the plane of the compartments (23) in order to withdraw a container (21) from a compartment (23), and reversely.

5. System according to claim 2, characterized by the fact that the storage unit (20A) contains the compartments (23A) in rows arranged atop one another in the form of a hollow cylinder in such a way that the compartments of the row arranged atop of one another are aligned with each other in the form of columns, and that the transport device can be moved parallel to the axis of the thusly formed hollow cylinder in order to access the compartments (23) and rotate around a fulcrum (26) located on the axis of the thusly formed hollow cylinder.

6. System according to claim 5, characterized by the fact that the gripping apparatus of the transport device (25A) can be moved in radial direction in order to remove a container from a compartment (23A), and reversely.

7. System according to claim 1, wherein each compartment and every other compartment is provided with a door equipped with a locking device or a similar element provided with a locking device that can be released by the computing unit after the merchant code or the identification code of the customer has been entered and after a compartment or a container has been transported into the area of the opening or the other opening in a position that makes access to the compartment or the container possible.

8. System according to claim 7, wherein the display unit assigned to a first opening or another first opening is illuminated if a compartment or a container allocated for withdrawal/loading purposes is located behind it and a display unit assigned to another opening or another opening is illuminated once a locking signal indicating that the door assigned to the first opening or another first opening is locked has been produced and once a receipt signal was produced by the customer/merchant by activation of a receipt key.

* * * * *